US007101448B2

(12) United States Patent
Wydra

(10) Patent No.: US 7,101,448 B2
(45) Date of Patent: Sep. 5, 2006

(54) PROCESS FOR PRODUCING A CLADDING FOR A METALLIC COMPONENT

(75) Inventor: Gerhard Wydra, Oberschleissheim (DE)

(73) Assignee: MTU Aero Engines GmbH, Munich (DE)

( * ) Notice: Subject to any disclaimer, the term of this patent is extended or adjusted under 35 U.S.C. 154(b) by 252 days.

(21) Appl. No.: 10/347,273

(22) Filed: Jan. 21, 2003

(65) Prior Publication Data

US 2003/0111140 A1 Jun. 19, 2003

Related U.S. Application Data

(63) Continuation of application No. 09/720,137, filed on Aug. 2, 2001, now abandoned.

(30) Foreign Application Priority Data

Jun. 20, 1998 (DE) ..... 198 27 620

(51) Int. Cl.
*C23C 2/14* (2006.01)
*C23C 4/18* (2006.01)

(52) U.S. Cl. ..... 148/527; 148/531; 148/535; 148/537

(58) Field of Classification Search ..... 148/527, 148/530, 531, 537
See application file for complete search history.

(56) References Cited

U.S. PATENT DOCUMENTS

| | | | | |
|---|---|---|---|---|
| 3,761,301 | A * | 9/1973 | Sama et al. | 148/527 |
| 4,009,146 | A * | 2/1977 | Cork et al. | 524/428 |
| 4,241,113 | A * | 12/1980 | Martinengo et al. | 148/535 |
| 4,464,430 | A * | 8/1984 | Baldi | 428/201 |
| 5,523,165 | A * | 6/1996 | Walter et al. | 428/469 |
| 6,440,499 | B1 * | 8/2002 | Wydra et al. | 427/376.8 |

FOREIGN PATENT DOCUMENTS

| | | |
|---|---|---|
| DE | 29 10 562 | 9/1980 |
| FR | 2 244 011 | 4/1975 |
| FR | 2 397 468 | 2/1979 |
| JP | 58-197203 | 11/1983 |
| JP | 60-089503 | 5/1985 |

* cited by examiner

*Primary Examiner*—George Wyszomierski
(74) *Attorney, Agent, or Firm*—Crowell & Moring LLP

(57) ABSTRACT

The invention relates to a process for producing a cladding for a metallic component, such as for example a tip of a turbine blade, which cladding is provided on that surface of the component which is to be clad, the process being simple and inexpensive to carry out in terms of manufacturing technology and involving the following steps: producing a slip by mixing a powder, which contains at least one of the elements Ni, Cr or Ce, with a binder; applying the slip to the surface which is to be clad; adding ceramic particles before or after the slip is applied; drying the slip at a temperature of from room temperature to 300° C.; and alitizing the layer of slip.

20 Claims, No Drawings

PROCESS FOR PRODUCING A CLADDING FOR A METALLIC COMPONENT

This is a continuation of application Ser. No. 09/720,137, filed Aug. 8, 2001, now abandoned.

The invention relates to a process for producing a cladding for a metallic component, which cladding is provided on the surface of this component.

Claddings or stripproof coatings are provided, for example, on drive components, such as for example tips of labyrinth seals or blade tips, in order to counteract the wear to these tips in the event of stripping phenomena during operation. Since the efficiency of a compressor or a turbine is to a large extent dependent on the gap size between the rotating component and the stationary component, this efficiency is reduced with increasing wear, for example to the blade tips.

When the drive mechanism is operating, the cladding usually works its way into a run-in coating of an opposite, second component. Run-in coatings of this type are abradable and usually consist of a corrosion- and erosion-resistant layer. A cladding for the drive component is required in particular when the strength and hardness of the run-in coatings are increased in order to improve the erosion and temperature resistance and in addition the wear to the drive components is increased. The cladding ensures that stripping forms the minimum possible gap between the cladding and the run-in coating.

In a known process for producing a cladding, an MCrAlY powder is applied by electro-depositing to the component which is to be clad, the hard particles required, such as for example BN, being contained in the bath. These particles are exposed by etching after the application. A process of this type is expensive and complex. In particular, the subsequent etching represents a drawback on account of lacking environmental compatibility and the need to cover the material.

In another known process, a solder foil which is adapted to the contours of the component is attached thereto by adhesive bonding or the like. Then, BN particles are inserted into the solder foil. After that, the solder foil is fused by heat treatment and the BN particles are embedded therein. This process is also relatively expensive and complex. In addition, the bond between the particles and the component is insufficient.

It is known from JP 55-82765 A to coat the substrate, which consists of an Ni- or Co-base alloy, firstly with a mixture of ceramic, Al and metal powder, in order to improve the thermal stability of the layer which is exposed to high temperatures for prolonged periods. This is followed by a layer of an Ni powder which has been provided with a binder, a heat treatment and alitizing using a pack process. The first layer of the ceramic-containing mixture is intended to prevent Al from this layer penetrating into the substrate, which would consequently cause the layer to lose its thermal stability on account of the Al depletion.

JP 55-082759 A has disclosed a process for improving the thermal stability of a coating which is applied to a substrate of an Ni- or Co-base alloy, a metal or alloy powder being mixed with ceramic elements during the coating and then being applied to the substrate. It is possible to use a binder and to carry out a subsequent heat treatment. The process is used for components of, for example, gas turbines which are exposed to hot-gas corrosion.

The object of the present invention is to provide a process for producing a cladding of the generic type described in the introduction which can be carried out as easily as possible in terms of manufacturing technology and results in a high-quality cladding.

According to the invention, the solution to this object is characterized by the following steps: producing a slip by mixing a powder, which contains at least one of the elements Ni or Cr or Ce, with a binder; applying the slip to the surface which is to be clad; adding hard ceramic particles to the slip before or after the slip is applied, the size of which particles is selected in such a way that they project above the layer following alitizing; drying the slip at a temperature of from room temperature to 300° C.; and alitizing the layer of slip.

The advantage of this process is that the cladding can be applied to the component using a process which is simple in terms of manufacturing technology. In addition, the hard ceramic particles are embedded in the layer of slip, which has a cavity level of from 0 to 40%, and are firmly joined to the component.

In a preferred configuration of the process, the particles are admixed to the slip before it is applied to the surface which is to be clad. In this way, the particles are distributed uniformly in the slip, which is in the form of a suspension.

In an alternative configuration, the particles are introduced into the slip after it has been applied, so that it is possible, for example, to achieve a specific arrangement of the particles on the surface which is to be clad.

It is preferable to use particles of BN, SiC or $Al_2O_3$, since these particles are harder than the layer of slip and, during operation, are able to cut into run-in coatings or the like.

Furthermore, it is preferable for the slip to be produced from a powder of MCrAlY, the powder preferably having a grain size distribution of from 5 to 120 μm. In this context, the M represents at least one of the elements Ni, Co, Pt or Pd. As an alternative to Y, it is also possible to use Hf or Ce.

The slip is preferably applied to that surface of the component which is to be clad by spraying, brushing or dipping, allowing the process to be carried out easily and inexpensively in terms of manufacturing technology. This method of application makes it easy to apply locally delimited layers to even geometrically complicated components. In addition, there is no need for expensive and complex spraying or vapour deposition installations.

The drying of the slip, which together with the organic or inorganic binder is in a suspension, is preferably carried out over a period of 0.5–4 hours, a period of 1–2 hours having proven particularly advantageous.

Furthermore, it is preferable for the layer of slip to be heat-treated at a temperature of from 750 to 1,200° C. under argon or in vacuo, the heat treatment of the layer preferably being carried out over a period of 1–4 hours, in order to bond the layer of slip to the component by diffusion.

In a preferred configuration of the process, the final step of alitizing the layer is carried out at a temperature of between 800 and 1,200° C. and over a period of 1–12 hours.

The metallic component preferably consists of a nickel-base or cobalt-base alloy, in which case the component may be a drive component, e.g. a turbine blade, to the tip of which the cladding is applied.

Further preferred configurations of the invention are described in the subclaims.

The invention is explained in more detail below with reference to an example.

In one configuration of the process for producing a cladding, firstly, to produce a slip, an MCrAlY powder is mixed with a standard inorganic binder to form a suspension. The suspension contains 80–90% by weight of the MCrAlY powder, 5–10% by weight of the binder and, in addition, 5–7% by weight of water. The grain sizes of the particles of the MCrAlY powder are between 5 and 120 μm. BN particles, the size of which is greater than that of the MCrAlY powder particles, are introduced into this free-flowing, sprayable mass.

Then, the tip of a turbine blade made from a nickel-base alloy is dipped into the mass in such a manner that a layer of slip forms on the blade tip which is to be clad. Alternatively, the slip containing the particles could also be applied to the blade tip, for example, using a brush, so as to form a layer. In the next step, the still wet slip which is in the form of a suspension or the layer of slip is dried at room temperature over a period of approximately 1.5 hours.

The dried layer of slip is then heat-treated in vacuo at 1,000° C. for 1 hour, in order to bond the layer of slip to the material of the turbine blade by diffusion. Next, the layer is alitized using a standard method at approximately 1,100° C. for 4 hours, in-order to further strengthen the bond with the drive blade by diffusion and to compact the layer of slip. In the process, Al penetrates into the layer and into the base material of the turbine blade and ensures both a strong bond between the layer and the component and a strong bond between the spherical MCrAlY particles. In addition, the MCrAlY particles, which are in spherical form, are at least partially sintered together. Furthermore, it is also possible for Ni to escape from the base material and diffuse into the layer of slip. Following the alitizing step, the hard ceramic particles of BN or the like project outward beyond the layer of slip and can protect this layer, as well as the blade tip, during operation.

By means of the layer of slip, the BN particles are firmly bonded to the blade tip and, while the gas turbine is operating, during a stripping operation, can cut into an opposite run-in coating, in order in this way to prevent damage to the blade tip and to minimize the gap size between the rotating component and the stationary component.

The invention claimed is:

1. Process for producing a cladding for a turbine blade, which cladding is provided on the tip of this blade, characterized by the following steps: producing a slip by mixing a powder, which contains at least one of the elements Ni or Cr or Ce, with a binder; applying the slip to the surface which is to be clad; adding hard ceramic particles to the slip before or after the slip is applied, the size of which particles is selected in such a way that they project above a layer of slip following alitizing; drying the slip at a temperature of from room temperature to 300° C.; and alitizing the layer of slip.

2. Process according to claim 1, characterized in that the particles are admixed to the slip before it is applied.

3. Process according to claim 2, characterized in that particles of BN, SiC or $Al_2O_3$ are used.

4. Process according to claim 2, characterized in that the slip is produced from a powder of MCrAlY.

5. Process according to claim 2, characterized in that the powder is present with a grain size distribution of from 5 to 120 micron.

6. Process according to claim 1, characterized in that the particles are introduced into the slip after it has been applied.

7. Process according to claim 6, characterized in that particles of BN, SiC or $Al_2O_3$ are used.

8. Process according to claim 6, characterized in that the slip is produced from a powder of MCrAlY.

9. Process according to claim 6, characterized in that the powder is present with a grain size distribution of from 5 to 120 micron.

10. Process according to claim 1, characterized in that particles of BN, SiC or $Al_2O_3$ are used.

11. Process according to claim 10, characterized in that the powder is present with a grain size distribution of from 5 to 120 micron.

12. Process according to claim 1, characterized in that the slip is produced from a powder of MCrAlY.

13. Process according to claim 12, characterized in that the powder is present with a grain size distribution of from 5 to 120 micron.

14. Process according to claim 1, characterized in that the powder is present with a grain size distribution of from 5 to 120 micron.

15. Process according to claim 1, characterized in that the application is carried out by spraying, brushing or dipping.

16. Process according to claim 1, characterized in that the drying is carried out over a period of 0.5–4 hours.

17. Process according to claim 1, characterized in that the layer of slip is heat-treated at a temperature of from 750 to 1,200° C. under argon or in vacuo prior to the alitizing.

18. Process according to claim 17, characterized in that the heat treatment is carried out over a period of 1 to 4 hours.

19. Process according to claim 1, characterized in that the surface which is to be clad consists of a nickel-base or cobalt-base alloy.

20. Process according to claim 1, characterized in that the alitizing is carried out at a temperature of between 800 and 1,200° C. and for a period of from 1 to 12 hours.

* * * * *